US011939972B2

(12) United States Patent
Nguyen et al.

(10) Patent No.: US 11,939,972 B2
(45) Date of Patent: Mar. 26, 2024

(54) ROTOR ASSEMBLY WITH REMOVABLE ROLLERS

(71) Applicant: BLUE-WHITE INDUSTRIES, LTD., Huntington Beach, CA (US)

(72) Inventors: John T. Nguyen, Fountain Valley, CA (US); Robert E. Gledhill, III, Huntington Beach, CA (US)

(73) Assignee: BLUE-WHITE INDUSTRIES, LTD., Huntington Beach, CA (US)

( * ) Notice: Subject to any disclaimer, the term of this patent is extended or adjusted under 35 U.S.C. 154(b) by 369 days.

(21) Appl. No.: 17/306,697

(22) Filed: May 3, 2021

(65) Prior Publication Data

US 2021/0348602 A1 Nov. 11, 2021

Related U.S. Application Data

(60) Provisional application No. 63/020,720, filed on May 6, 2020.

(51) Int. Cl.
*F04B 53/22* (2006.01)
*F04B 43/12* (2006.01)

(52) U.S. Cl.
CPC ..... *F04B 43/1276* (2013.01)

(58) Field of Classification Search
CPC .. F04B 43/1253; F04B 43/0009; F04B 53/22; F04B 43/1276
USPC ..... 418/225; 74/572.2
See application file for complete search history.

(56) References Cited

U.S. PATENT DOCUMENTS

| | | | | |
|---|---|---|---|---|
| 4,558,996 | A * | 12/1985 | Becker | F04B 43/1253 417/374 |
| 4,705,464 | A | 11/1987 | Arimond | |
| 7,001,153 | B2 | 2/2006 | McDowell et al. | |
| 7,284,964 | B2 | 10/2007 | McDowell et al. | |
| 8,215,931 | B2 | 7/2012 | McDowell et al. | |
| 8,418,364 | B2 | 4/2013 | McDowell et al. | |
| 8,639,363 | B2 | 1/2014 | Gledhill, III et al. | |
| 9,374,024 | B2 | 6/2016 | Nguyen et al. | |
| 9,389,109 | B2 | 7/2016 | Gledhill, III et al. | |
| 9,777,720 | B2 | 10/2017 | Gledhill, III et al. | |
| 9,828,984 | B2 | 11/2017 | Gledhill, III et al. | |
| 9,909,579 | B2 | 3/2018 | Gledhill, III et al. | |
| 9,996,089 | B2 | 6/2018 | Gledhill, III et al. | |
| 10,330,094 | B2 | 6/2019 | Gledhill, III et al. | |
| 10,948,320 | B2 | 3/2021 | Gledhill, III et al. | |
| 11,131,300 | B2 | 9/2021 | Gledhill, III et al. | |
| 11,150,118 | B2 | 10/2021 | Gledhill, III et al. | |
| 11,221,004 | B2 | 1/2022 | Gledhill, III et al. | |
| 11,261,857 | B2 | 3/2022 | Gledhill, III et al. | |
| D959,238 | S | 8/2022 | Nguyen et al. | |

(Continued)

FOREIGN PATENT DOCUMENTS

WO WO 2021/089762 A1 5/2021

*Primary Examiner* — Philip E Stimpert
*Assistant Examiner* — Dnyanesh G Kasture
(74) *Attorney, Agent, or Firm* — Knobbe, Martens, Olson & Bear, LLP

(57) ABSTRACT

A rotor assembly for a peristaltic pump is provided. The rotor assembly includes a hub configured to couple with a drive shaft of a pump. The hub includes at least one receiving slot that extends longitudinally along an outer surface of the hub. The rotor assembly further includes a roller assembly configured to slide longitudinally along the receiving slot to seat the roller assembly onto the hub.

8 Claims, 9 Drawing Sheets

(56) References Cited

U.S. PATENT DOCUMENTS

| | | | | |
|---|---|---|---|---|
| 11,402,248 | B2 | 8/2022 | Gledhill, III et al. | |
| 11,485,653 | B2 | 11/2022 | Gledhill, III et al. | |
| 11,578,716 | B2 | 2/2023 | Gledhill, III et al. | |
| 11,639,863 | B2 | 5/2023 | Nguyen et al. | |
| 11,703,362 | B2 | 7/2023 | Nguyen et al. | |
| 11,754,065 | B2 | 9/2023 | Nguyen et al. | |
| 11,768,092 | B2 | 9/2023 | Gledhill, III et al. | |
| 11,768,929 | B2 | 9/2023 | Gledhill, III et al. | |
| 11,781,709 | B2 | 10/2023 | Nguyen et al. | |
| 2007/0031272 | A1 | 2/2007 | Ramirez et al. | |
| 2010/0005655 | A1 | 1/2010 | Nguyen | |
| 2011/0180172 | A1 | 7/2011 | Gledhill, III et al. | |
| 2015/0037188 | A1* | 2/2015 | Tuckey ..... | F01C 21/0809 418/229 |
| 2015/0211509 | A1 | 7/2015 | Gledhill, III et al. | |
| 2018/0087942 | A1 | 5/2018 | Gledhill, III et al. | |
| 2018/0291886 | A1 | 10/2018 | Gledhill, III et al. | |
| 2018/0298891 | A1 | 10/2018 | Gledhill, III et al. | |
| 2019/0017499 | A1 | 1/2019 | Gledhill, III et al. | |
| 2019/0234394 | A1 | 8/2019 | Gledhill, III et al. | |
| 2020/0149522 | A1 | 5/2020 | Gledhill, III et al. | |
| 2020/0386593 | A1 | 12/2020 | Nguyen et al. | |
| 2021/0047209 | A1 | 2/2021 | Gledhill, III et al. | |
| 2021/0054963 | A1 | 2/2021 | Nguyen et al. | |
| 2021/0064735 | A1 | 3/2021 | Gledhill, III et al. | |
| 2021/0324845 | A1 | 10/2021 | Nguyen et al. | |
| 2022/0099083 | A1 | 3/2022 | Gledhill, III et al. | |
| 2022/0316463 | A1 | 10/2022 | Gledhill, III et al. | |
| 2023/0287881 | A1 | 9/2023 | Murphy et al. | |
| 2023/0358222 | A1 | 11/2023 | Gledhill, III et al. | |

* cited by examiner

ROTOR ASSEMBLY WITH REMOVABLE ROLLERS

INCORPORATION BY REFERENCE TO ANY PRIORITY APPLICATIONS

This application claims priority to U.S. Provisional Application No. 63/020,720, filed May 6, 2020, and entitled "ROTOR ASSEMBLY WITH REMOVABLE ROLLERS," the disclosure of which is hereby incorporated by reference in its entirety.

BACKGROUND

Field

Certain embodiments discussed herein relate to methods, systems, and devices for pumping with a peristaltic pump.

Discussion of the Related Art

Peristaltic pumps pump fluids or slurries without the fluid or slurry coming into direct contact with the pump. The peristaltic pump head has rollers that pinch a portion of tubing between the roller and a housing that surrounds the pump head. As the pump head rotates, the tubing pinch point moves along the tubing and drives fluid within the tubing ahead of the pinch point. In this way, peristaltic pumps can pump fluids or slurries without making contact with the pumped material.

SUMMARY

The systems, methods and devices described herein have innovative aspects, no single one of which is indispensable or solely responsible for their desirable attributes. Without limiting the scope of the present disclosure, some of the advantageous features will now be summarized.

Aspects of the present disclosure relate to apparatuses and methods for peristaltic pumping applications. In some variants, a pump rotor assembly having removable rollers is provided herein. In some aspects, the pump rotor assembly includes a hub configured to couple with a drive shaft of a pump. The hub can comprise at least one receiving slot that extends longitudinally along an outer surface of the hub. The pump rotor assembly can also include a roller assembly configured to slide longitudinally along the receiving slot to seat the roller assembly onto the hub.

In some aspects, the pump rotor assembly includes a hub configured to couple with a drive shaft of a pump. The hub can comprise at least one receiving slot that extends in an axial direction relative to the hub. The pump rotor assembly can also include a roller assembly configured to slide in the axial direction along the receiving slot to seat the roller assembly onto the hub.

In some implementations, the pump rotor assembly can further comprise a collar configured to couple with the hub and block the roller assembly from exiting the receiving slot.

In some instances, the receiving slot can comprise an abutment surface that faces toward a first face of the hub and is longitudinally recessed relative to the first face of the hub.

In some instances, the receiving slot can further comprise a track that extends longitudinally away from the abutment surface.

In some designs, the receiving slot can further comprise a stop surface. The abutment surface can be disposed between the stop surface and the first face of the hub. The stop surface can span a gap between a pair of sidewalls of the receiving slot.

In some implementations, the roller assembly can comprise an arm configured to be captured between the collar and the abutment surface when the collar blocks the roller assembly from exiting the receiving slot.

In some variants, a method of loading a piece of tubing into a peristaltic pump is provided. The method can include coupling a hub to a drive shaft of the peristaltic pump. The hub can have at least one receiving slot configured to receive a roller assembly. The method can include coupling a hub to a drive shaft of the peristaltic pump. The method can include placing the piece of the tubing between the hub and a housing of the peristaltic pump with the roller assembly vacant from the at least one receiving slot. The method can also include placing the roller assembly in the receiving slot. The method can also include securing the roller assembly in the receiving slot. The method can include rotating the hub to compress the tubing against the housing with a roller of the roller assembly.

In some implementations, the method can further comprise inserting a second roller assembly into a second receiving slot of the hub, and rotating the hub to compress the tubing against the housing with the second roller assembly.

In some variants, a pump rotor assembly is provided. The pump rotor assembly can comprise a hub configured to couple with a drive shaft of a pump. The hub can comprise at least a first interface surface that extends longitudinally along the hub. The pump rotor assembly can also comprise a roller assembly comprising a second interface surface configured to slide longitudinally along the first interface surface to seat the roller assembly onto the hub.

In some implementations, the pump rotor assembly can further comprise a lock configured to couple with the hub and block the roller assembly from moving longitudinally along the first interface surface in a first axial direction.

In some variants, a method of loading a piece of tubing into a peristaltic pump is provided. The method can include coupling a hub to a drive shaft of the peristaltic pump. The hub can have at least one interface surface configured to cooperate with at least one interface surface of a roller assembly. The method can include placing the piece of tubing between the hub and a housing of the peristaltic pump with a roller assembly not engaged with the at least one interface surface of the hub. The method can also include positioning the roller assembly into engagement with the hub, so that the interface surface of the hub engages the interface surface of the roller assembly. The method can also include securing the roller assembly with respect to the hub, so that the interface surface of the hub is engaged with the interface surface of the roller assembly. The method can also include rotating the hub to compress the tubing against the housing with a roller of the roller assembly.

In some instances, the method can further comprise positioning a second roller assembly into engagement with the hub, so that a second interface surface of the hub engages the interface surface of the second roller assembly. The method can include securing the roller assembly with respect to the hub, so that the second interface surface of the hub is engaged with the interface surface of the second roller assembly. The method can also include rotating the hub to compress the tubing against the housing with the second roller assembly.

Any of the features, components, or details of any of the arrangements or embodiments disclosed in this application, including without limitation any of the rotor systems and any of the methods disclosed below, are interchangeably combinable with any other features, components, or details of any of the arrangements or embodiments disclosed herein to form new arrangements and embodiments.

BRIEF DESCRIPTION OF THE DRAWINGS

Throughout the drawings, reference numbers can be reused to indicate general correspondence between reference elements. The drawings are provided to illustrate example aspects described herein and are not intended to limit the scope of the disclosure.

DETAILED DESCRIPTION

While the present description sets forth specific details of various embodiments, it will be appreciated that the description is illustrative only and should not be construed in any way as limiting. Furthermore, various applications of such embodiments and modifications thereto, which may occur to those who are skilled in the art, are also encompassed by the general concepts described herein.

Figure 1:
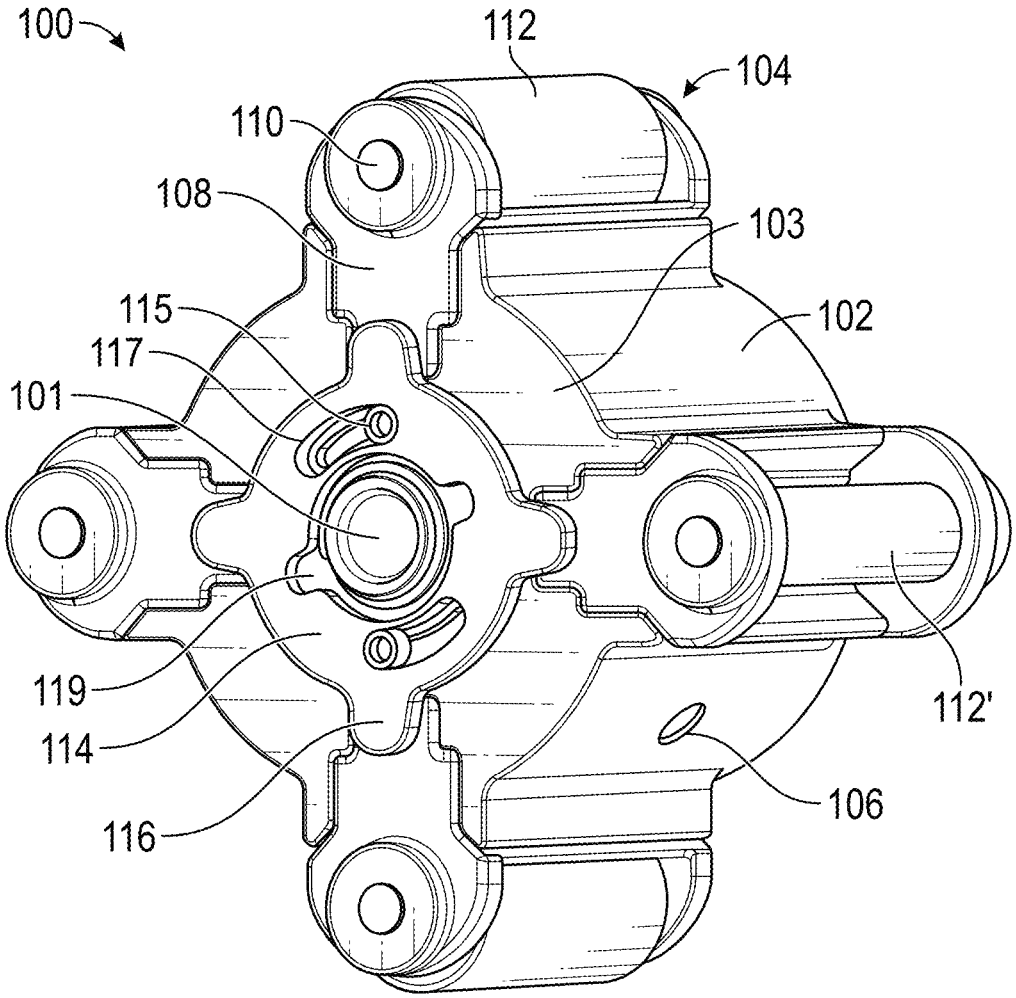
FIG. 1 shows a perspective partial front view of an embodiment of a rotor assembly according to some aspects of the present disclosure.

FIG. 1 shows an embodiment of a pump rotor assembly 100 according to some aspects of the present disclosure. The pump rotor assembly 100 can have a central opening 101 for mounting the pump rotor assembly 100 axially onto a drive shaft of a motor. The pump rotor assembly 100 can include a hub 102 and one or more roller assemblies 104. The hub 102 can be configured to couple with a drive shaft of a pump. In some aspects, the roller assembly 104 can be configured to attach to the hub 102 by sliding in an axial direction relative to the hub 102, as described herein. The hub 102 can include a fastening feature 106 that allows the hub 102 to be secured onto a drive shaft of a motor. In operation, the drive shaft of the motor can rotate the hub 102, and the roller assemblies 104 attached thereto, about the axis of the central opening 101.

With continued reference to FIG. 1, the roller assembly 104 can include a support frame 108 that supports an axle 110. A roller 112 can be mounted on the axle 110. The rotor assembly 100 can include different diameter rollers 112, 112', as shown in FIG. 1. The pump rotor assembly 100 can include a collar 114. The collar 114 can help secure the roller assembly 104 onto the hub 102, as described herein. The collar 114 can include a blocking surface, such as a protrusion or tab 116, that can be moved into a locked position wherein the tab 116 blocks the roller assembly 104 from moving axially relative to the hub 102. The tab 116 can be moved to an unlocked position or removed from the hub 102 such that the roller assembly 104 can be inserted onto, or removed from, the hub 102 in an axial direction. The collar 114 can be secured to the hub 102 by one or more collar fasteners 115. In the illustrated embodiment, a pair of diametrically opposed collar fasteners 115 are used to secure the collar 114 to the hub 102. The collar fastener 115 can be seated within an opening 117 defined by the collar 114, as shown in FIG. 1. The collar 114 can include a tool interface, such as the illustrated recesses 119, that facilitates rotation of the collar 114. The fastener 115 can be configured to slide within the opening 117 to allow collar 114 to rotate in one direction only. In some aspects, a tool can be inserted into the recesses 119 to move the tab 116 into the locked configuration. In some aspects, the collar 114 can be rotated between the locked and unlocked configurations while maintaining the collar 114 connection to the hub 102 (e.g., while the collar 114 engages the axial face 103 of the hub 102). In some aspects, roller assemblies 104 can be attached to or removed from the hub 102 while maintaining the collar 114 connection to the hub 102. For example, the collar 114 can be removed from the hub or rotated to the unlocked configuration; a roller assembly 104 can be inserted onto the hub 102 in an axial direction; the collar 114 can be moved to the locked position such that the roller assembly 104 is blocked from moving relative to the hub 102 in the axial direction, thereby locking the roller assembly 104 onto the hub 102. As shown in FIG. 1, the collar 114 can have a plurality of blocking surfaces, such as a plurality of tabs 116 that can each lock a roller assembly 104 into place on hub 102. The collar 114 may have more than two tabs 116, more than three tabs 116, more than four tabs 116, more than five tabs 116 or more than six tabs 116. The collar 114 may have less than three, four, five or six tabs 116. The collar 114 may include two to eight tabs 116, three to eight tabs 116, four to eight tabs 116, or three to six tabs 116.

Figure 2:
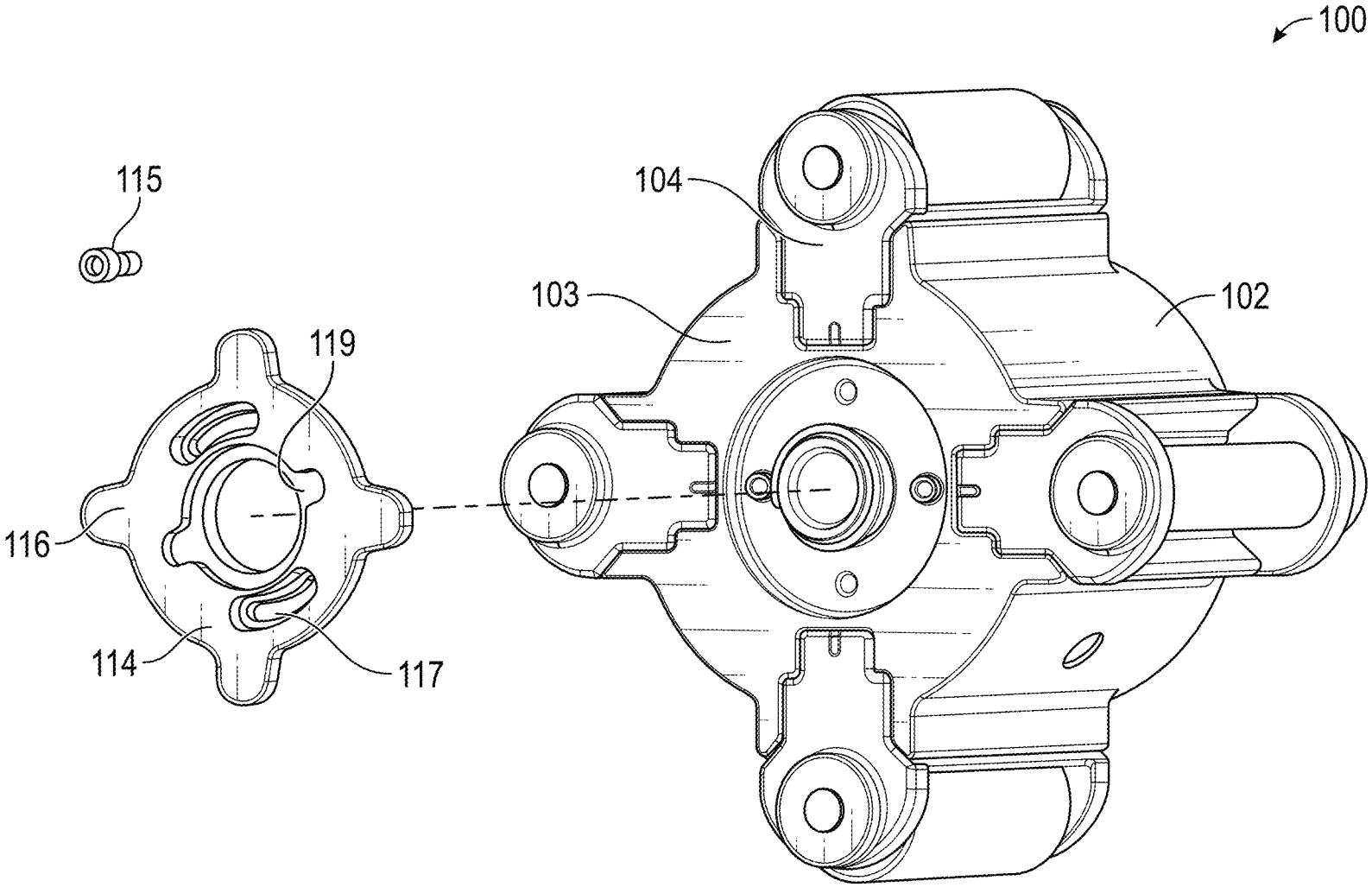
FIG. 2 shows an exploded view of the rotor assembly of FIG. 1.

FIG. 2 shows the rotor assembly 100 with the collar 114 removed from hub 102. A fastener 115 can pass through the opening 117 to secure the collar 114 to the hub 102 (e.g., so that the collar 114 engages the axial face 103 of the hub 102), as described herein. In some aspects, the rotor assembly 100 comprises a receiving portion disposed on the hub 102 that couples with a corresponding receiving structure disposed on the roller assembly 104 such that the roller assembly 104 can be reversibly coupled to the hub 102. In the illustrated embodiment, the hub 102 defines a slot-like interface structure that receives a corresponding interface portion defined by the frame 108 of the roller assembly 104.

Figure 3:
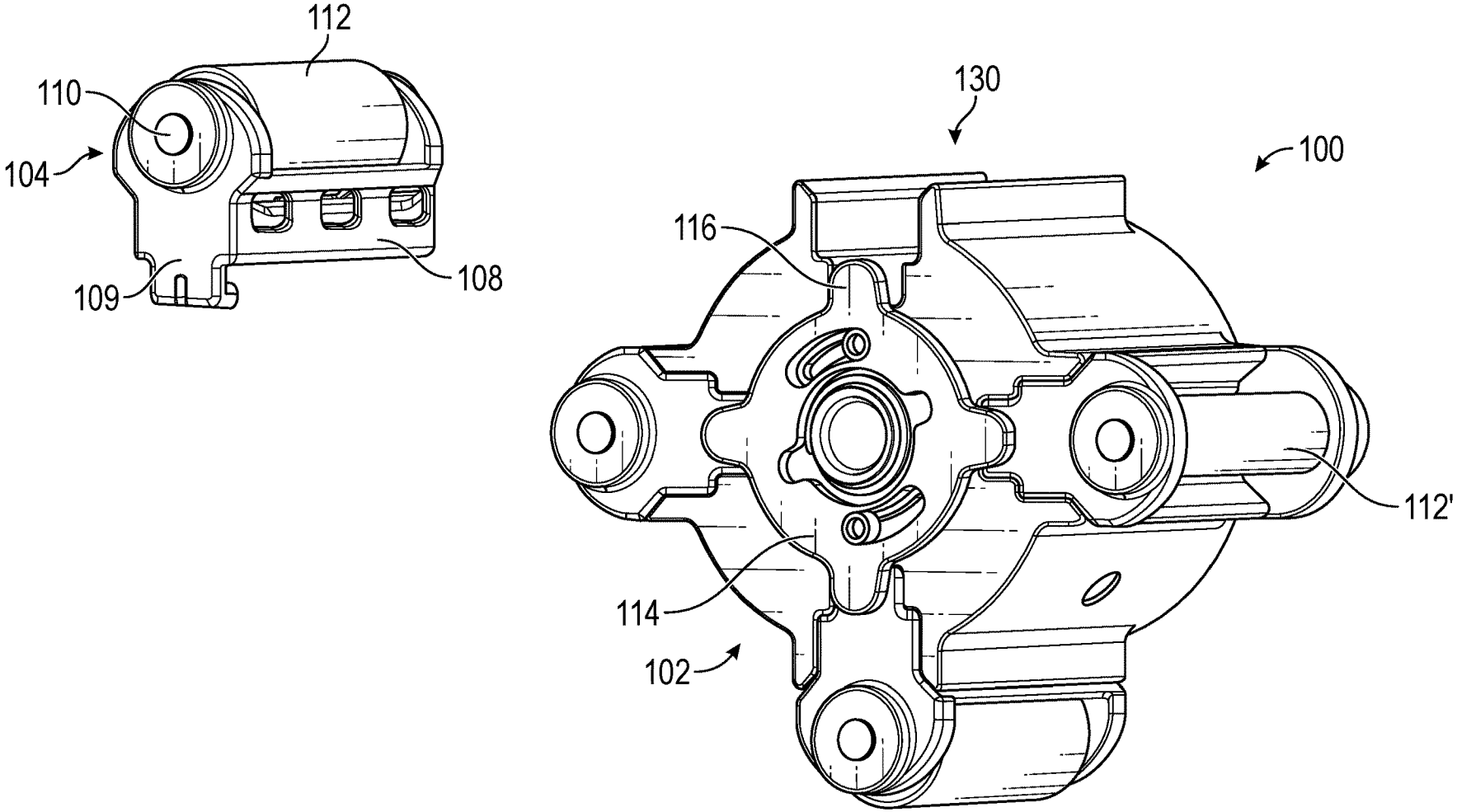
FIG. 3 shows a roller assembly removed from the rotor assembly of FIG. 1.

FIG. 3 shows the rotor assembly 100 of FIG. 1 with one roller assembly 104 detached from the hub 102 and three roller assemblies 104 attached to the hub 102. The hub 102 can include an interface surface or structure that extends longitudinally along the hub 102. For example, the hub 102 can include an interface surface or structure that extends longitudinally along an outer surface of the hub 102. The roller assembly 104 can include an interface surface or structure configured to slide longitudinally along the interface surface or structure of the hub 102 to seat the roller assembly 104 onto the hub 102. As discussed, the hub 102 can include an interface surface or structure, such as a retaining portion (e.g., a receiving slot 130) that is configured to receive and retain a corresponding interface surface or structure, such as a retaining portion (e.g., frame 108) of the roller assembly 104. The hub retaining portion and the roller retaining portion can be configured to constrain the relative motion between the roller assembly 104 in the axial direction, the radial direction and/or the circumferential direction of the hub 102. The illustrated hub 102 has four retaining portions that are each configured to receive a roller assembly 104 inserted axially therein. For example, the illustrated hub 102 can include a receiving slot 130 that extends longitudinally along the hub 102, e.g., along an outer surface of the hub 102 or in an axial direction relative to the hub 102. A roller assembly 104 can be configured to slide along the receiving slot 130 to seat the roller assembly 104 onto the hub 102, e.g., longitudinally or in the axial direction along the receiving slot 130. In the illustrated embodiment, the roller assemblies 104 are equally spaced apart circumferentially on the hub 102. As discussed above, other numbers and arrangements of the roller assemblies 104 can be used. In some aspects, the rotor assembly 100 can include roller assemblies 104 that have different diameter rollers 112. For example, in the illustrated embodiment, the detached roller assembly 104 has a roller 112 that has a diameter that is greater than that of the roller 112' of the roller assemblies 104 that are immediately adjacent to the receiving slot 130 that has been vacated by the detached roller assembly 104. In various implementations, the rotor assembly 100 can include a lock (e.g., collar 114) configured to couple with the hub 102 and block the roller assembly 104 from moving longitudinally or in an axial direction along the interface surface or structure of the hub 102. As described herein, the collar 114 can be configured to couple with the hub 102 and block a roller assembly 104 from exiting a receiving slot 130. In FIG. 3, the collar 114 is shown attached to the hub 102 in the locked configuration. As can be appreciated with reference to FIG. 3, when the tab 116 is in the locked position, the tab 116 can overlap an arm portion 109 of the support frame 108 of the roller assembly 104 such that the roller assembly 104 is blocked from exiting the slot 130 in the axial direction.

Figure 4:
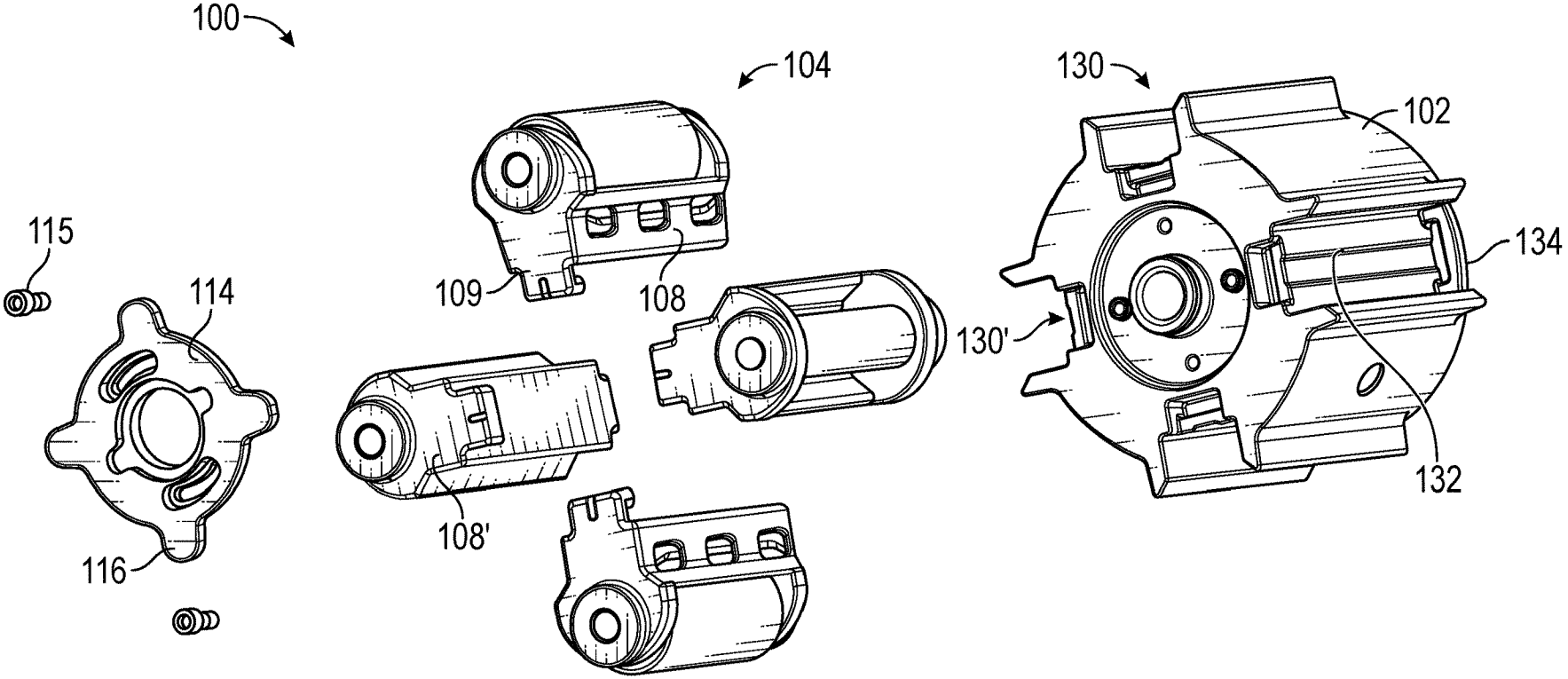
FIG. 4 shows an assembly view of the rotor assembly of FIG. 1.

FIG. 4 shows an assembly view of the rotor assembly 100. In some aspects, the receiving portion of the hub 102 can include a track (e.g., a linear track) 132, as shown. The roller assembly 104 can be configured to slide along the linear track 132 in the axial direction to seat against a stop surface 134 at end of linear track 132. The stop surface 134 can be a unitary structure of hub 102. In some variants, the stop surface 134 can be removable from the hub 102.

Figure 5:
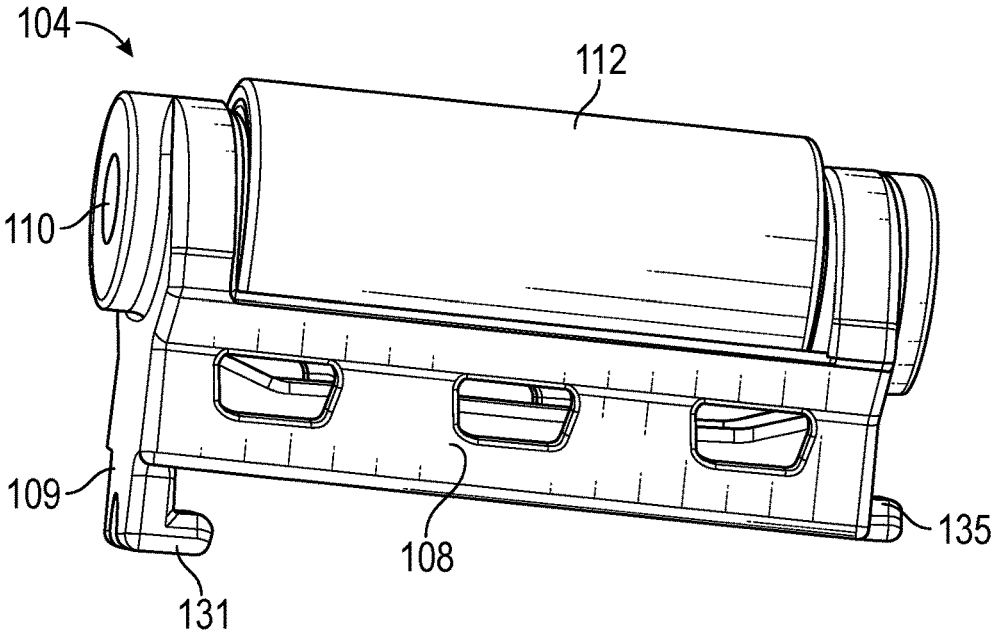
FIG. 5 shows a partial side view of a roller assembly according to some aspects of the present disclosure.

FIG. 5 shows a side view of a roller assembly 104. The roller assembly 104 has a roller 112 mounted on an axle 110 that is supported by the frame 108 of the roller assembly. The frame 108 can include features that help lock the roller assembly 104 onto the hub 102 so that the roller assembly 104 is fixed relative to the hub 102 in the axial direction, the radial direction, and the circumferential direction of the hub 102. As discussed, the frame 108 can include an arm portion 109 that is blocked from exiting the slot 130 in the axial direction by the tab 116 (FIG. 3). The frame 108 can include a first seating portion, such as a hook 131. The hook 131 can be sized to fit within a first mating seat, such as recess 136 (FIG. 6) of the hub 102, as discussed herein. The frame 108 can include a second seating portion, such as a toe 135 (FIG. 5) which can be located on an opposite end of the frame 108 than the hook 131. The toe 135 can be sized to pass into or through second mating seat, such as an opening 140 (FIG. 6) of the stop surface 134, as described herein.

Figure 6:
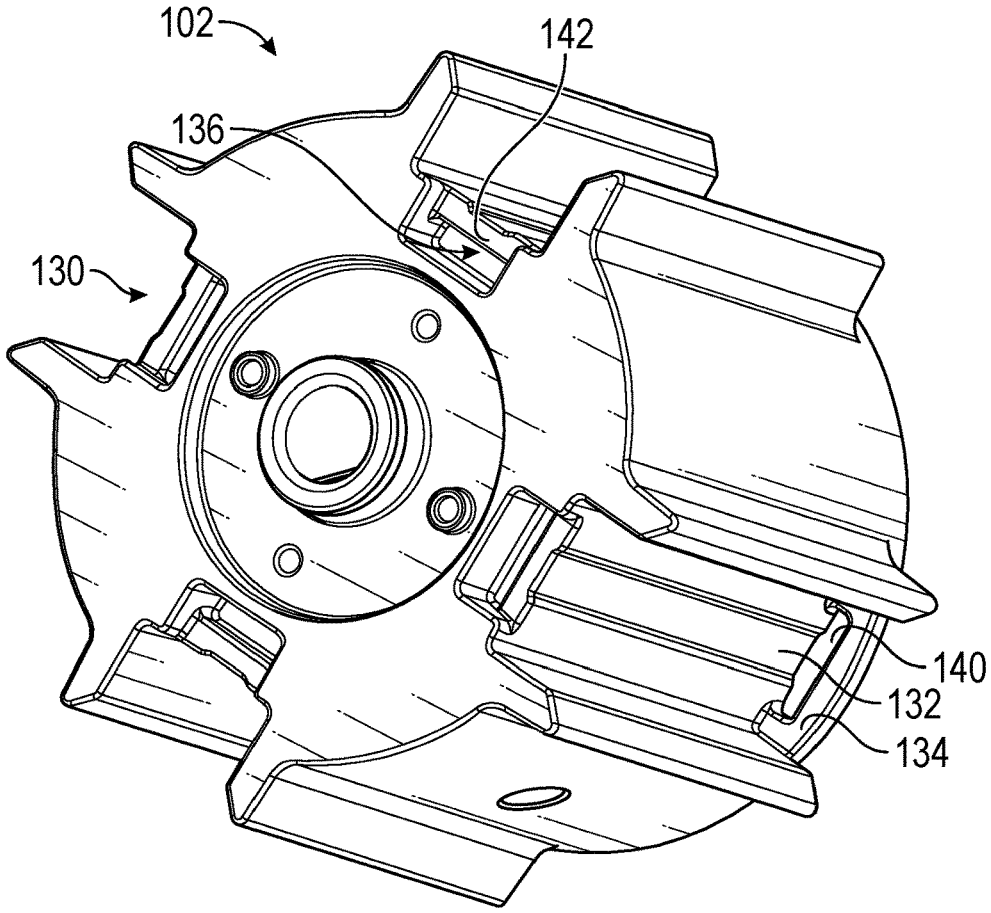
FIG. 6 shows a partial front and side view of a rotor hub according to some aspects of the present disclosure.

FIG. 6 shows a partial front and side view of the hub 102. The hub 102 can include a longitudinal track 132 that extends in an axial direction along an outer surface of the hub 102. In the illustrated embodiment, the longitudinal track 132 extends from the stop surface 134 to an abutment surface 142 at the opposing end of the longitudinal track 132. For example, the abutment surface 142 can face toward a first face of the hub 102. The track 132 can extend longitudinally away from the abutment surface 142. In some instances, the abutment surface 142 can be longitudinally recessed relative to the first face of the hub 102. In some instances, the abutment surface 142 can be disposed between the stop surface 134 and the first face of the hub 102. The stop surface 134 can span a gap between a pair of sidewalls of the receiving slot 130. The abutment surface 142 can contact the arm portion 109 of the roller assembly 104 when the roller assembly 104 is fully seated in the slot 130 of the receiving portion of the hub 102. The abutment surface 142 and the stop surface 134 can limit the axial movement of the roller assembly 104 along the slot 130 in a first axial direction. The tab 116 (FIG. 3) of the collar 114 can limit the movement of the roller assembly in a second axial direction that is opposite the first axial direction. For example, the arm portion 109 of the roller assembly 104 can be configured to be captured between the collar 114 and the abutment surface 142 when the collar 114 blocks the roller assembly 104 from exiting the receiving slot 130. The frame 108 can be sized to fit into the track 132. The track 132 can be configured to guide the roller assembly 104 onto hub 102. In some aspects, the track 132 can guide the toe 135 into or through the opening 140 of the stop surface 134. In some variants, the toe 135 can be received within a recess or dead end opening rather than the illustrated opening 140.

Figure 7:
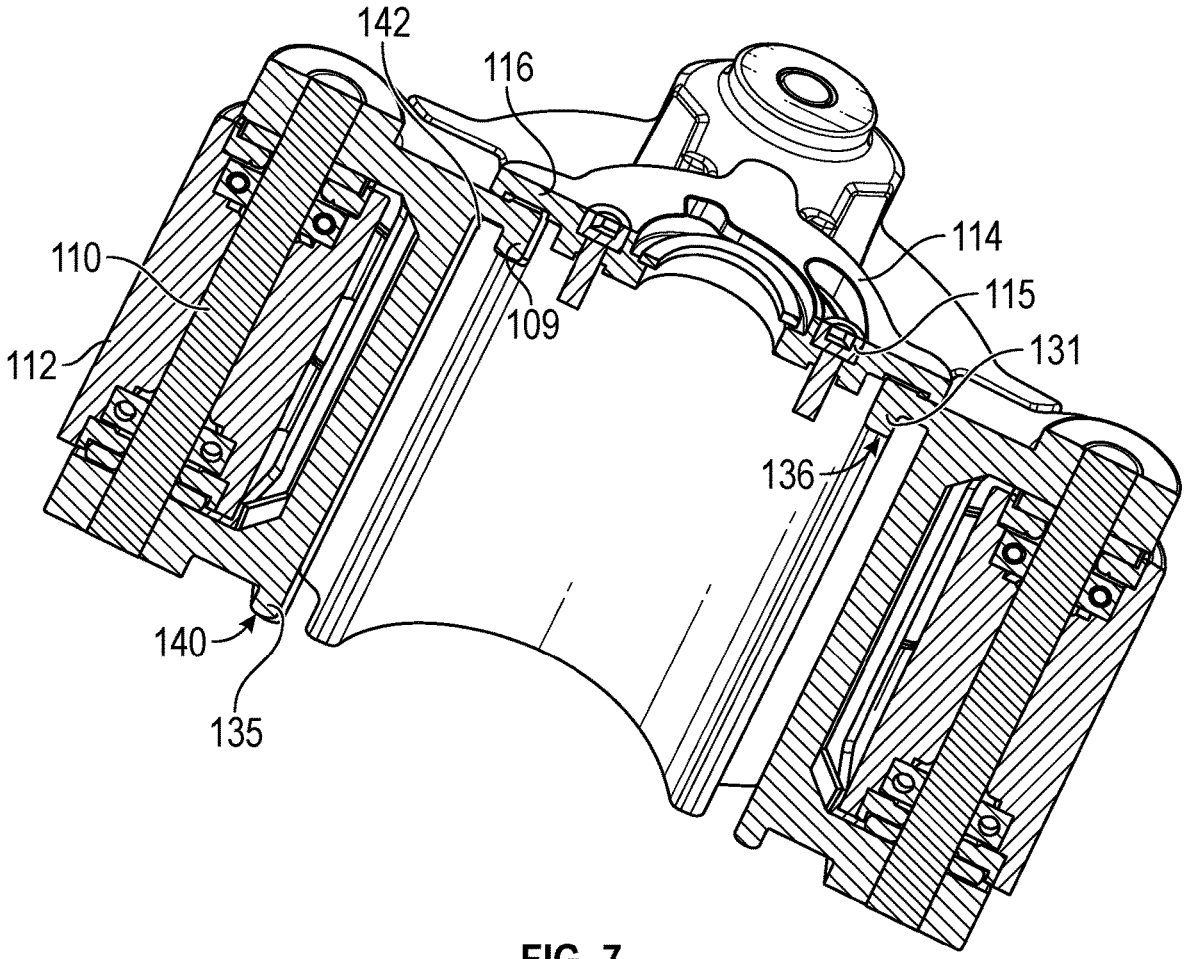
FIG. 7 shows a longitudinal cross-section of the rotor assembly of FIG. 1.

FIG. 7 is a longitudinal cross-sectional view of the roller assembly 100 of FIG. 1. The tab 116 is shown in the locked configuration, whereby the arm portion 109 of the roller assembly 104 is pinned between the tab 116 and the abutment surface 142. The hook 131 of the frame 108 is seated within recess 136 of the hub 102. In some aspects, the recess 136 and the hook 131 can constrain movement of the roller assembly 104 relative to the hub 102 in the radial direction of the hub 102. The toe 135 of the roller assembly extends through the opening 140, as described herein.

Figure 8A:
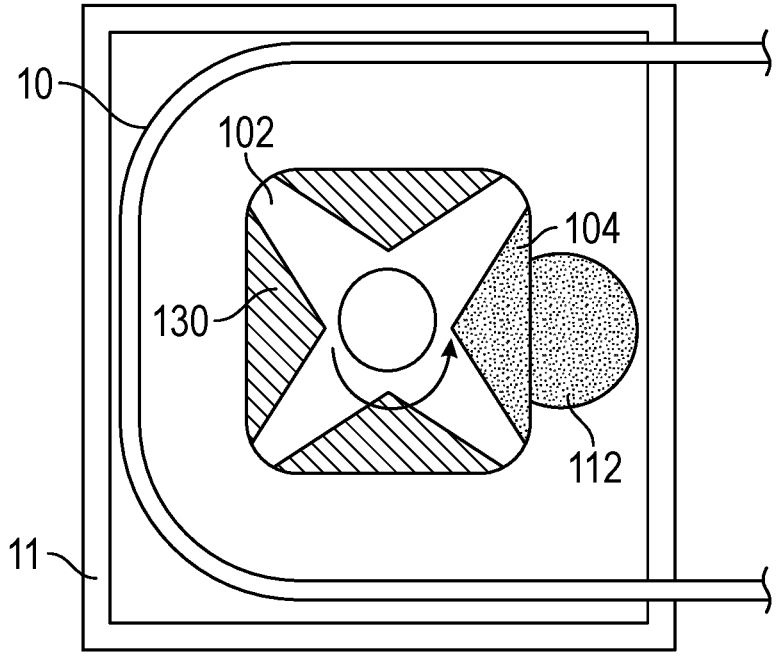
FIGS. 8A-8D show a schematic representation of a method of loading a pump tubing onto a rotor assembly according to some aspects of the present disclosure.
Figure 8B:
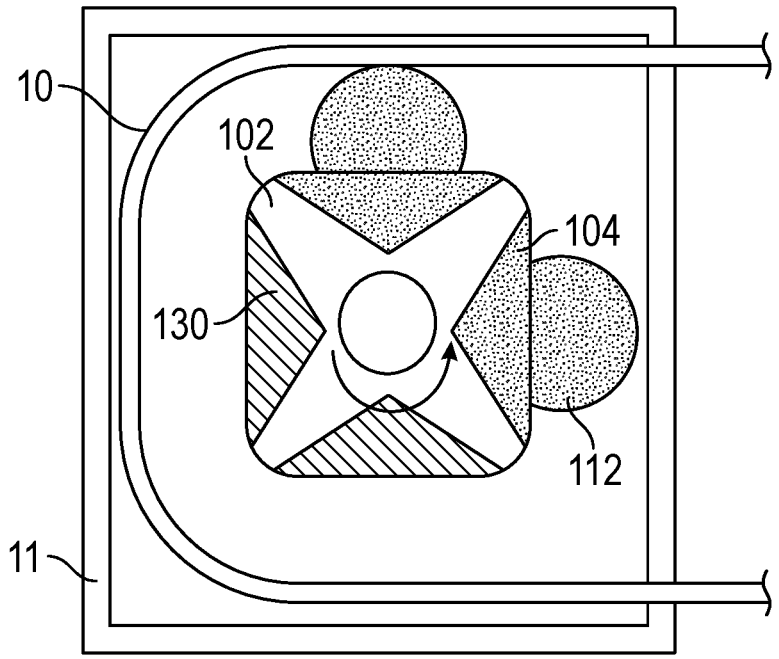
Figure 8C:
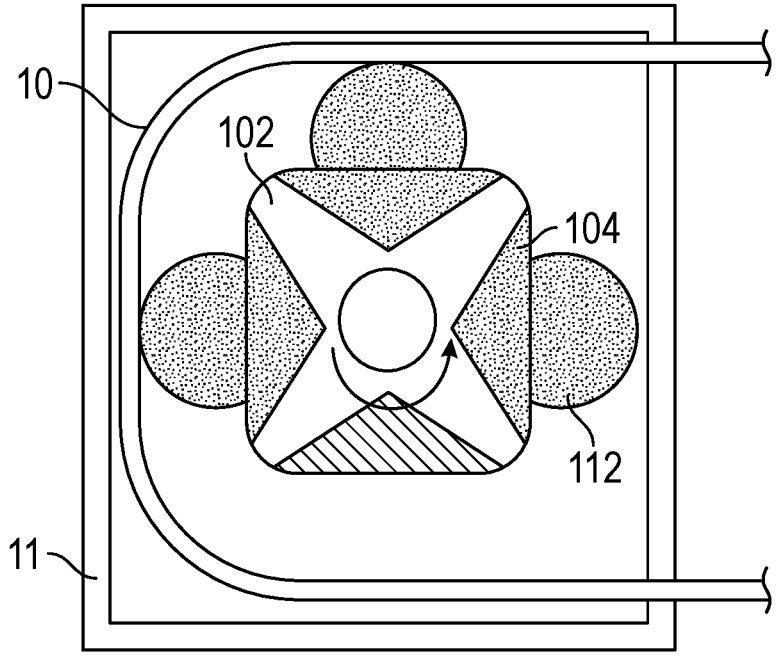
Figure 8D:
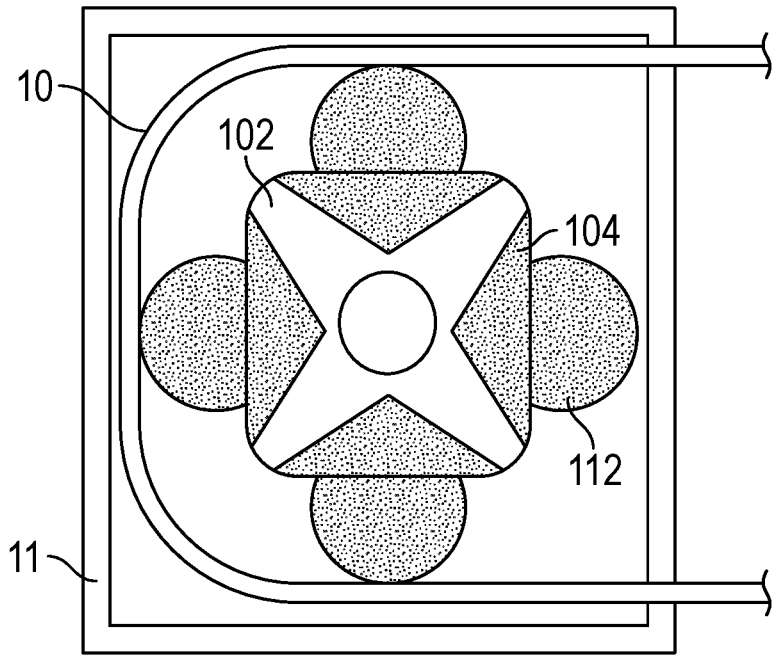

FIGS. 8A-8D illustrate a method of loading a pump tubing 10 into a pump head of a peristaltic pump having a rotor assembly 100 according to some aspects of the present disclosure. The hub 102 can be coupled (e.g., mounted) onto the drive shaft of the pump with one or more of the roller assemblies 104 removed from the hub 102. The tubing 10 can be placed or positioned between the hub 102 and the housing 11 of the pump head while one or more roller assemblies 104 are vacant from one or more receiving slots 130 (e.g., removed from the hub 102). In the illustrated embodiment, one roller assembly 104 is attached to the hub 102 and the other three receiving portions (e.g., slot 130) of the hub 102 are vacant. As can be appreciated with reference to FIG. 8A, the removal of one or more roller assemblies 104 from the hub 102 can facilitate loading the tubing 10 between the hub 102 and the housing 11 of the pump head by providing more clearance for the tubing 10 to fit between the roller 112 of the roller assembly 104 and the housing 11 of the pump head. With reference to FIGS. 8B-8D, the roller assemblies 104 can be added to the hub 102 (e.g., placed and secured in a receiving slot 130) one at a time as the hub 102 is rotated. Rotation of the hub 102 can bring the roller assembly 104 into contact with the tubing 10 to compress (e.g., pinch) the tubing 10 between the roller 112 and the housing 11. This serial addition of the roller assemblies 104 to the hub 102 can reduce or eliminate the likelihood of pinching the fingers of a user while loading the tubing 10 onto a pump head of a peristaltic pump.

In various implementations, a method of loading a piece of tubing into a peristaltic pump is provided. The method can include coupling a hub 102 to a drive shaft of the pump. The hub 102 can have at least one interface surface (e.g., slot 130) configured to cooperate with at least one interface surface (e.g., frame 108) of a roller assembly 104. The method can include placing the piece of tubing between the hub 102 and a housing of the pump with a roller assembly 104 not engaged with the interface surface of the hub 102. The method can include positioning the roller assembly 104 into engagement with the hub 102, so that the interface surface of the hub 102 engages the interface surface of the roller assembly 104. The method can include securing the roller assembly 104 with respect to the hub 102, so that the interface surface of the hub 102 is engaged with the interface surface of the roller assembly 104. The method can also include rotating the hub 102 to compress the tubing against the housing with a roller 112 of the roller assembly 104.

In various instances, the method can also include positioning a second roller assembly 104 into engagement with the hub 102, so that a second interface surface of the hub 102 engages the interface surface of the second roller assembly 104. The method can include securing the roller assembly 104 into engagement with the hub 102, so that the second interface surface of the hub 102 is engaged the interface surface of the second roller assembly 104. The method can further include rotating the hub 102 to compress the tubing against the housing with the second roller assembly 104.

Figure 9:
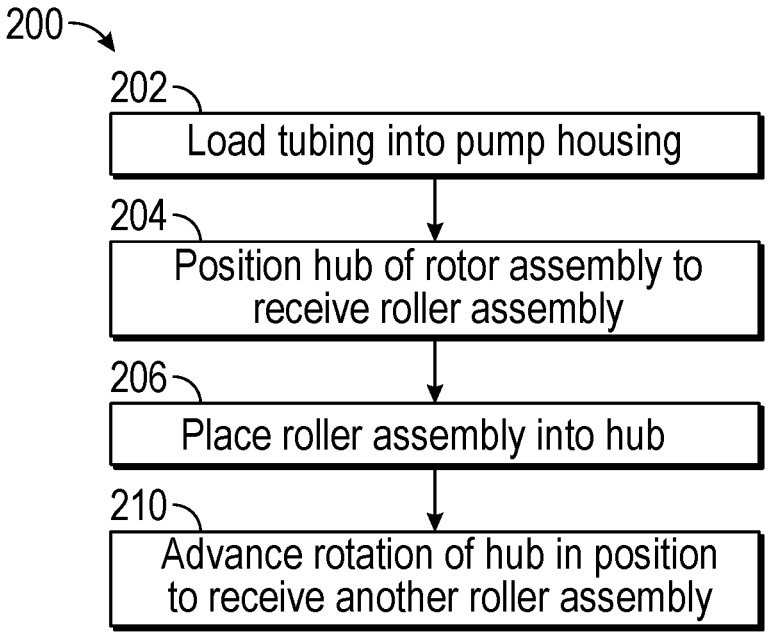
FIG. 9 shows a flowchart representation of a method of loading a pump tubing into a rotor assembly according to some aspects of the present disclosure.

FIG. 9 depicts a method 200 of loading a pump tubing onto a pump head of a peristaltic pump. The method 200 can include the step 202 of loading the tubing into the pump housing. In some aspects, the tubing is loaded into the pump housing by positioning the tubing within the housing such that the tubing encircles at least a portion of the hub 102 with the hub 102 coupled to the drive shaft of the pump. In some aspects the method 200 further includes the step 204 of positioning the hub 102 such that a receiving portion of the hub, such as vacant receiving portion of the hub 102, and specifically the slot 130, is available to receive a roller assembly 104. In some aspects, the method 200 further includes the step 206 of placing or coupling a roller assembly 104 to a vacant receiving portion of the hub 102. In some aspects, the method 200 further includes the step 210 of advancing a rotation of the hub 102 on the drive shaft to bring another vacant receiving portion of the hub 102 in position to receive a roller assembly 104. The method 200 can further include repeating step 204, step 206, and step 210 until all receiving portions of the hub 102 hold a roller assembly 104.

While the preferred embodiments of the present inventions have been described above, it should be understood that they have been presented by way of example only, and not of limitation. It will be apparent to persons skilled in the relevant art that various changes in form and detail can be made therein without departing from the spirit and scope of the inventions. Thus the present inventions should not be limited by the above-described exemplary embodiments, but should be defined only in accordance with the following claims and their equivalents. Furthermore, while certain advantages of the inventions have been described herein, it is to be understood that not necessarily all such advantages may be achieved in accordance with any particular embodiment of the inventions. Thus, for example, those skilled in the art will recognize that the inventions may be embodied or carried out in a manner that achieves or optimizes one advantage or group of advantages as taught herein without necessarily achieving other advantages as may be taught or suggested herein.

What is claimed is:

1. A pump rotor assembly for a peristaltic pump, the pump rotor assembly comprising:

a hub configured to couple with a drive shaft of a pump, the drive shaft having an axis of rotation, the hub comprising at least one receiving slot that extends in an axial direction parallel to the axis of rotation and an axial face that is transverse to the axial direction;

a first roller assembly comprising a first support frame, a first axle and a first roller, the first roller assembly configured to slide in the axial direction along the receiving slot to seat the first roller assembly onto the hub; and a collar configured to couple with the hub, so that the collar engages the axial face of the hub, wherein the collar is selectably movable between (1) a first position wherein the collar is engaged with the axial face of the hub and the collar permits the first roller assembly to be removed from the at least one receiving slot by moving towards the axial face and (2) a second position wherein the collar is engaged with the axial face of the hub and the collar blocks the first roller assembly from exiting the at least one receiving slot.

2. The pump rotor assembly of claim 1, wherein the receiving slot comprises an abutment surface that faces toward a first face of the hub and is longitudinally recessed relative to the first face of the hub.

3. The pump rotor assembly of claim 2, wherein the receiving slot further comprises a track that extends longitudinally away from the abutment surface.

4. The pump rotor assembly of claim 2, wherein the receiving slot further comprises a stop surface, the abutment surface disposed between the stop surface and the first face of the hub, the stop surface spanning a gap between a pair of sidewalls of the receiving slot.

5. The pump rotor assembly of claim 2, wherein the first roller assembly comprises an arm configured to be captured between the collar and the abutment surface when the collar blocks the first roller assembly from exiting the receiving slot.

6. A pump rotor assembly comprising:

a hub configured to couple with a drive shaft of a pump, the hub comprising at least a first hub interface surface that extends longitudinally in a direction parallel to a hub rotation direction along the hub and an axial face that is transverse to the hub rotation direction;

a first roller assembly comprising a first support frame, a first axle and a first roller, the first roller assembly further comprising a first roller assembly interface surface configured to permit the first roller assembly to slide longitudinally in the direction parallel to the hub rotation direction along the first hub interface surface, through the interaction of the first hub interface surface and the first roller assembly interface surface to seat the first roller assembly onto the hub; and a collar configured to couple with the hub, so that the collar engages the axial face of the hub, wherein the collar is selectably movable between (1) a first position wherein the collar is engaged with the axial face of the hub and the collar permits the first roller assembly to be removed from the first hub interface surface by moving towards the axial face and (2) a second position wherein the collar is engaged with the axial face of the hub and the collar blocks the first roller assembly from separating from the first hub interface surface.

7. The pump rotor assembly of claim 6, said hub further comprising a second hub interface surface that extends longitudinally along the hub, said pump rotor assembly further comprising a second roller assembly comprising a second support frame, a second axle and a second roller, the second roller assembly further comprising a second roller interface surface configured to permit the second roller assembly to slide longitudinally along the second hub interface surface, through the interaction of the second hub interface surface and the second roller interface surface to seat the second roller assembly onto the hub.

8. The pump rotor assembly of claim 7, further comprising a lock configured to couple with the hub and block the first roller assembly from moving longitudinally along the first hub interface surface in a first axial direction.

* * * * *